US008616999B2

(12) United States Patent
Greaney et al.

(10) Patent No.: US 8,616,999 B2
(45) **Date of Patent: *Dec. 31, 2013**

(54) GOLF CLUB HEAD

(71) Applicant: Taylor Made Golf Company, Inc., Carlsbad, CA (US)

(72) Inventors: Mark Vincent Greaney, Vista, CA (US); Brandon Woolley, Vista, CA (US); Ian Wright, Calgary (CA); Todd P. Beach, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/657,065

(22) Filed: Oct. 22, 2012

(65) Prior Publication Data

US 2013/0045818 A1 Feb. 21, 2013

Related U.S. Application Data

(63) Continuation of application No. 13/447,609, filed on Apr. 16, 2012, now Pat. No. 8,292,756, which is a continuation of application No. 13/204,487, filed on Aug. 5, 2011, now Pat. No. 8,157,672, which is a continuation of application No. 12/316,921, filed on Dec. 16, 2008, now Pat. No. 8,012,039.

(60) Provisional application No. 61/080,203, filed on Jul. 11, 2008, provisional application No. 61/008,690, filed on Dec. 21, 2007.

(51) Int. Cl.
*A63B 53/04* (2006.01)

(52) U.S. Cl.
USPC ..... 473/329; 473/330; 473/345; 473/349

(58) Field of Classification Search
USPC ..... 473/324–350, 287–292
See application file for complete search history.

(56) References Cited

U.S. PATENT DOCUMENTS

| | | | |
|---|---|---|---|
| 2,395,837 | A | 3/1946 | Baymiller et al. |
| 4,471,961 | A | 9/1984 | Masghati et al. |
| 5,366,223 | A | 11/1994 | Werner et al. |

(Continued)

FOREIGN PATENT DOCUMENTS

| | | |
|---|---|---|
| JP | 11-089976 | 9/1997 |
| JP | 2004-501688 | 1/2004 |

(Continued)

OTHER PUBLICATIONS

U.S. Appl. No. 08/321,588, filed Oct. 11, 1994, Mitsuhiro Saso.

(Continued)

*Primary Examiner* — Sebastiano Passaniti
(74) *Attorney, Agent, or Firm* — Klarquist Sparkman, LLP

(57) ABSTRACT

A golf club head with an increased moment of inertia (MOI) about the X axis and the Z axis. Generally, the MOI about the Z axis is at least about 4400 g·cm$^2$ and the MOI about the X axis is at least about 2500 g·cm$^2$. The radius of the bulge of the club face is increased while the radius of the roll is reduced to compensate for the gear effect produced by the increased MOIs. The bulge curvature is generally between about 0.016 cm$^{-1}$ and about 0.028 cm$^{-1}$, and the roll curvature is between about 0.033 cm$^{-1}$ and about 0.066 cm$^{-1}$. The roll curvature is greater than the bulge curvature.

6 Claims, 8 Drawing Sheets

(56) References Cited

U.S. PATENT DOCUMENTS

| | | | |
|---|---|---|---|
| 5,380,010 | A | 1/1995 | Werner et al. |
| 5,645,495 | A | 7/1997 | Saso |
| 5,681,228 | A | 10/1997 | Mikame et al. |
| 5,916,043 | A | 6/1999 | Saso |
| 6,093,115 | A | 7/2000 | Murtland et al. |
| 6,428,426 | B1 | 8/2002 | Helmstetter et al. |
| 6,454,664 | B1 | 9/2002 | Long et al. |
| 6,458,043 | B1 | 10/2002 | McCabe et al. |
| 6,558,272 | B2 | 5/2003 | Helmstetter et al. |
| 6,582,322 | B2 | 6/2003 | Long et al. |
| 6,595,869 | B2 | 7/2003 | McCabe et al. |
| 6,620,055 | B2 | 9/2003 | Saso |
| 6,648,773 | B1 | 11/2003 | Evans |
| 6,800,038 | B2 | 10/2004 | Willett et al. |
| 6,824,475 | B2 | 11/2004 | Burnett et al. |
| 6,997,820 | B2 | 2/2006 | Willett et al. |
| 7,066,830 | B2 | 6/2006 | Day |
| 7,066,832 | B2 | 6/2006 | Willett et al. |
| 7,163,468 | B2 | 1/2007 | Gibbs et al. |
| 8,012,039 | B2 | 9/2011 | Greaney et al. |
| 8,157,672 | B2 | 4/2012 | Greaney et al. |
| 8,292,756 | B2 | 10/2012 | Greaney et al. |

FOREIGN PATENT DOCUMENTS

| | | |
|---|---|---|
| JP | 2004-216173 | 3/2004 |
| JP | 3554515 | 5/2004 |
| JP | 2004-261451 | 9/2004 |
| WO | WO92/19327 | 3/1992 |

OTHER PUBLICATIONS

"Adams Insight XTD a3 Driver Product Details, Reviews, Compare Prices," screenshot from http://www.golfalot.com/equipment-reviews/adams/insight-xtd-a3-driver.aspx on Feb. 26, 2009, 1 page.

"Insight XTD a30S Delivering Distance for Slower Swing Speeds," screenshot from http://www.adamsgolf.com/products/drivers/a3os/php on Jan. 15, 2009, 1 page.

Olson, "Adams Golf Introduces Insight XTD Drivers," The Sand Trap.com posted Dec. 4, 2007, 3 pages.

Office Action from the United States Patent & Trademark Office in pending U.S. Appl. No. 13/204,487, dated Oct. 4, 2011.

Notice of Allowance from the United States Patent & Trademark Office in co-pending U.S. Appl. No. 13/204,487, dated Dec. 29, 2011.

Notice of Allowance from the United States Patent & Trademark Office in co-pending U.S. Appl. No. 13/447,609, dated Jul. 11, 2011.

Office Action from the Japan Patent Office in pending JP Patent Application No. 2008-323222, dated Sep. 27, 2012, 4 pages.

GOLF CLUB HEAD

CROSS-REFERENCE TO OTHER APPLICATIONS

This application is a continuation of U.S. patent application Ser. No. 13/447,609, filed Apr. 16, 2012, now U.S. Pat. No. 8,292,756, which is a continuation of U.S. patent application Ser. No. 13/204,487, filed Aug. 5, 2011, now U.S. Pat. No. 8,157,672, which is a continuation of U.S. patent application Ser. No. 12/316,921, filed Dec. 16, 2008, now U.S. Pat. No. 8,012,039, which claims the benefit of U.S. Provisional Application Nos. 61/008,690, filed Dec. 21, 2007, and 61/080,203, filed Jul. 11, 2008, all of which applications are incorporated herein by reference.

FIELD

The present disclosure relates to a golf club head. More specifically, the present disclosure relates to a face plate of a wood-type golf club head, such as a driver or fairway wood, that is designed to hit a ball farther and more accurately when the face plate hits the ball outside of the "sweet spot."

BACKGROUND

When a golf club head strikes a golf ball, a force is seen on the club head at the point of impact. If the point of impact is aligned with the center of gravity (CG) of the golf club head in an area of the club face typically called the sweet spot, then the force has minimal twisting or tumbling effect on the golf club. However, if the point of impact is not aligned with the CG, outside the sweet spot for example, then the force can cause the golf club head to twist around the CG. This twisting of the golf club head causes the golf ball to acquire spin. For example, if a typical right handed golfer hits the ball near the toe of the club this can cause the club to rotate clockwise when viewed from the top down. This in turn causes the golf ball to rotate counter-clockwise which can result in the golf ball curving to the left. This phenomenon is what is commonly referred to as "gear effect." Recent manufacturing techniques that allow for a higher coefficient of restitution (COR) or the use of inverted cone technology (ICT) increase this gear effect.

Bulge and roll are golf club face properties that are generally used to compensate for this gear effect. The term "bulge" on a golf club typically refers to the rounded properties of the golf club face from the heel to the toe of the club face. If a club face is rounded, then the angle that the golf ball leaves the club face relative to the intended target line will be increased for off-center shots. For example, if a golf ball is hit near the heel of the club face, then the ball will leave in an initial direction to the left of the target line. As suggested above, with an off-center heel shot the ball can curve to the right so ideally the two effects will neutralize one another and produce a flight path that lands the ball close to the intended target line.

The term "roll" on a golf club typically refers to the rounded properties of the golf club face from the crown to the sole of the club face. When the club face hits the ball, the ball acquires some degree of backspin. Typically this spin is greater for shots hit below the center line of the club face than for shots hit above the center line of the club face.

Recent advances in manufacturing techniques and materials properties have enabled golf club manufacturers to increasingly vary the weight, shape and center of gravity of golf club heads. These advances allow the moment of inertia ("MOT") of the golf club heads to be increased, as disclosed for example in U.S. Pat. No. 6,648,773 B1 to Evans. Thus, the club head twists less when it strikes the ball off-center, as described above. This decreased twisting can lead to decreased ball spin, depending on the location of ball contact. Recent developments in high MOI clubs having conventional face configurations can lead to greater deviation for shots away from center face.

SUMMARY

In one embodiment, the present disclosure describes a golf club head comprising a club head body having an external surface with a heel portion, a toe portion, a crown, a sole, and a face. The club head further includes a moment of inertia about the CG Z axis, $I_{zz}$, which is at least about 4400 g·cm$^2$. The face further includes a bulge curvature and a roll curvature, and the bulge curvature is between about 0 cm$^{-1}$ and about 0.027 cm$^{-1}$ and the inverse of the bulge curvature is greater than the inverse of the roll curvature by at least 7.62 cm. In one embodiment, the moment of inertia about the CG x-axis, $I_{xx}$, is at least about 2500 g·cm$^2$, and in another embodiment $I_{xx}$ is at least about 3000 g·cm$^2$. In certain embodiments, $I_{zz}$ is greater than $I_{xx}$. In another embodiment, the face includes a front side and a back side that define a variable face thickness.

In certain embodiments, the ratio of the bulge curvature divided by the roll curvature is between about 0.28 and about 0.75 at a roll curvature between about 0.033 cm$^{-1}$ and about 0.066 cm$^{-1}$. In one embodiment, the ratio of the bulge curvature divided by the roll curvature is between about 0.33 and about 0.75 when $I_{zz}$ is between about 4400 g·cm$^2$ and about 5000 g·cm$^2$. In another embodiment, the ratio of the bulge curvature divided by the roll curvature is between about 0.31 and about 0.67 when the $I_{zz}$ is between about 5000 g·cm$^2$ and about 5500 g·cm$^2$. In a one embodiment, the ratio of the bulge curvature dived by the roll curvature is between about 0.28 and about 0.61 when the $I_{zz}$ is between about 5500 g·cm$^2$ and about 6000 g·cm$^2$. In yet another embodiment, the ratio of the bulge curvature divided by the roll curvature is between about 0.28 and about 0.56 when the $I_{zz}$ is about 6000 g·cm$^2$.

In certain described embodiments, the bulge curvature is between about 0.016 cm$^{-1}$ and about 0.027 cm$^{-1}$. In other embodiments, the roll curvature is between about 0.033 cm$^{-1}$ and about 0.066 cm$^{-1}$. In one embodiment, the ratio of the bulge curvature divided by the roll curvature is less than about 0.84 at a roll curvature of about 0.049 cm$^{-1}$. In some embodiments, the bulge curvature and the roll curvature are constant over the face of the golf club head.

In another embodiment, the present disclosure describes a golf club head comprising a club head body wherein the moment of inertia abut the CG Z axis, $I_{zz}$, is at least about 4400 g·cm$^2$, and the moment of inertia about the CG X axis, $I_{xx}$, is at least about 2500 g·cm$^2$ and $I_{zz}$ is greater than $I_{xx}$. Further, the ratio of the bulge curvature divided by the roll curvature, $R_C$, satisfies the following equation:

$$\frac{1}{3.3x10^{-4} \times I_{zz} + 0.9154} \leq R_C \leq \frac{1}{1.7x10^{-4} \times I_{zz} + 0.4574}.$$

In some embodiments, the golf club head has a volume greater than about 300 cubic centimeters, and the golf club head has a mass between about 170 grams and about 220 grams. In one embodiment, the golf club head has a volume between about 400 cubic centimeters and about 470 cubic centimeters.

In yet another embodiment, the present disclosure describes a golf club having a grip, a shaft and a golf club head, wherein the golf club head comprises a club head body wherein the moment of inertia abut the CG Z axis, $I_{zz}$, is at least about 4400 g·cm$^2$, and the moment of inertia about the CG X axis, $I_{xx}$, is at least about 2500 g·cm$^2$ and $I_{zz}$ is greater than $I_{xx}$. The ratio of the bulge curvature divided by the roll curvature, $R_C$, satisfies the following equation:

$$\frac{1}{(5.6x10^{-4} * I_{ZZ}) + 0.222} \leq R_C \leq \frac{1}{2.8x10^{-4} * I_{ZZ} + 0.111}.$$

The foregoing and other objects, features, and advantages of the invention will become more apparent from the following detailed description, which proceeds with reference to the accompanying figures.

DETAILED DESCRIPTION

General Configuration of the Golf Club Head

Figure 2:
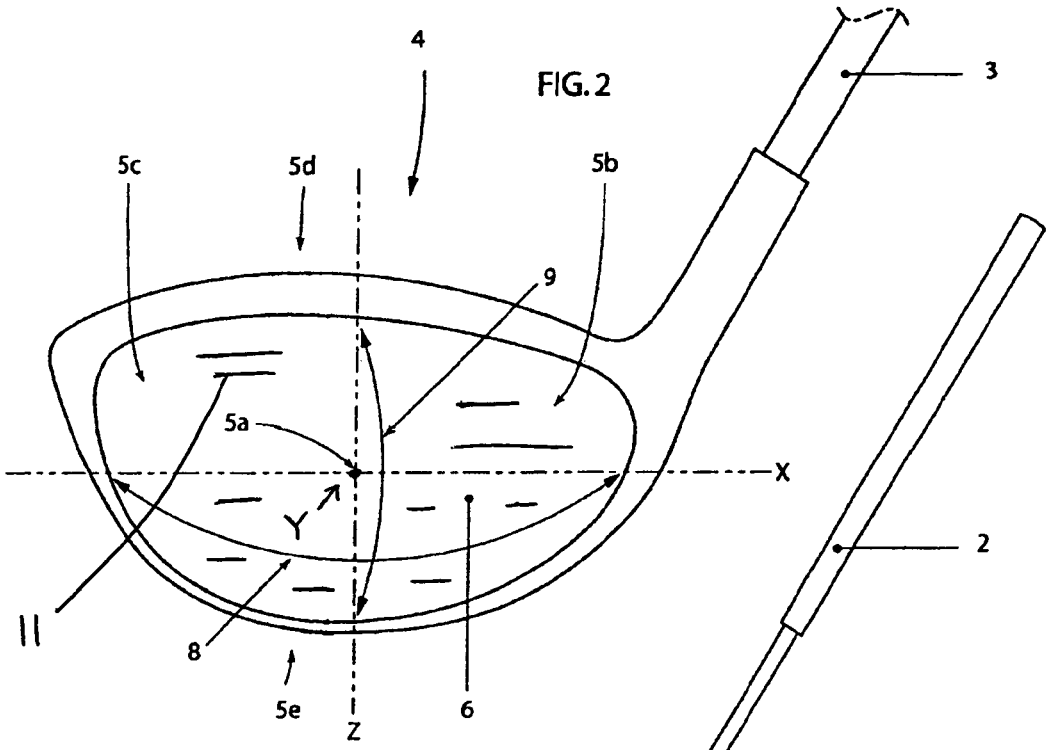
FIG. 2 is an illustration of an embodiment of a golf club including the club head of FIG. 1.
Figure 1:
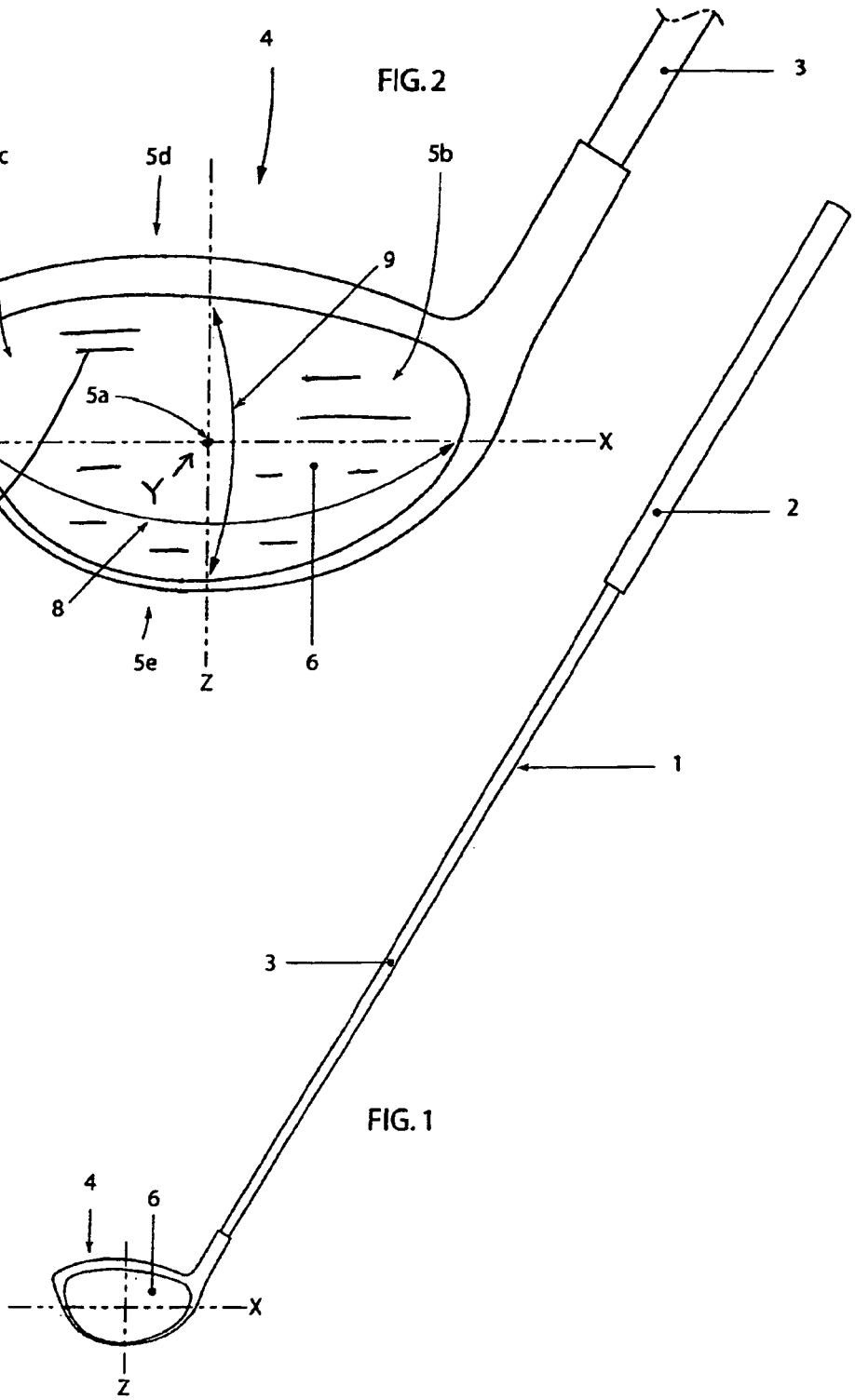
FIG. 1 is an illustration of an embodiment of a golf club according to the present disclosure.

FIGS. 1 and 2 show a golf club 1 comprising a grip 2, a shaft 3, and a club head 4. The club head 4 includes a center face 5*a*, a heel 5*b*, a toe 5*c*, a crown 5*d*, and a sole 5*e*. The club head 4 further comprises a club face 6 including a curvature from the heel 5*b* to the toe 5*c* commonly called a bulge 8. The club face 6 also includes a curvature from the crown 5*d* to the sole 5*e* commonly called a roll 9. In at least one embodiment, the combination of curvatures may provide a club face 6 with a substantially toroidal shape, or a shape similar to a section of a toroid. The club face 6 further includes an X-axis X which extends horizontally through the center face 5*a* from the heel 5*b* to the toe 5*c*, a Z-axis Z which extends vertically through the center face 5*a* from the crown 5*d* to the sole 5*e*, and a Y-axis Y which extends horizontally through the center face and into the page in FIG. 2. The X-axis X, Y-axis Y, and Z-axis Z are mutually orthogonal to one another.

Figure 3:
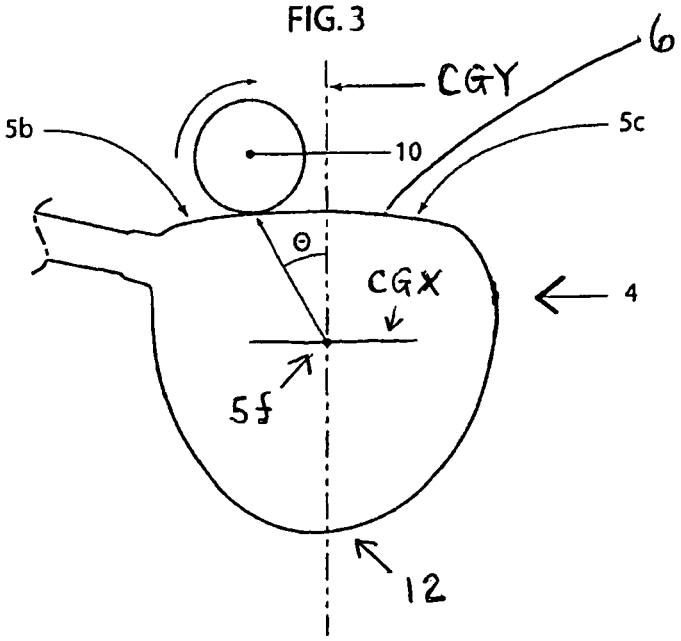
FIG. 3 is an illustration of the golf club head striking a golf ball on the heel of the golf club head.

As shown in FIG. 3, the club head 4 additionally has a center of gravity (CG) 5*f* which is internal to the club head. The club head 4 has a CG X-axis, a CG Y-axis, and a CG Z-axis which are mutually orthogonal to one another and pass through the CG 5*f* to define a CG coordinate system. The CG X-axis and CG Y-axis lie in a horizontal plane parallel to a flat ground surface. The CG Z-axis lies in a vertical plane orthogonal to a flat ground surface. In one embodiment the CG Y-axis may coincide with the Y-axis Y, but in most embodiments the axes do not coincide.

Embodiments of the presently disclosed club head 4 have a volume between about 300 cubic centimeters (cc) to about 500 cc, as measured by the currently standard USGA water displacement test. Preferred embodiments have a volume between about 400 cc to about 470 cc. Other embodiments may have a volume even greater than 500 cc. Additionally, embodiments of the presently disclosed club head 4 have a mass between about 170 grams and about 220 grams, though higher or lower mass may be used and still stay within the spirit and scope of the disclosure.

FIG. 3 is an exaggerated depiction of the club head 4 striking a golf ball 10 on the heel 5*b* of the club head. As shown, and as will be further described in FIG. 4B, this imparts a clockwise spin to the golf ball 10 which causes the golf ball 10 to curve to the right during flight. As discussed above, striking the golf ball 10 on the heel 5*b* of the club head 4 will cause the golf ball 10 to leave the club head 4 at an angle Θ relative to the CG Y-axis of the club head 4. It will be understood that the angle Θ merely depicts a general angle at which the ball will leave the club head and is not intended to depict or imply the actual angle relative to the centerline, or the point from which that angle would be measured. Angle Θ further illustrates that a ball struck on the heel of the club will initially travel on a flight path to the left of the centerline.

Bulge and Roll—Terminology

The method used to obtain the values in the present disclosure is the optical comparator method. Referring back to FIG. 1, the club face 6 includes a series of score lines 11 which traverse the width of the club face generally along the X-axis X of the club head 4. In the optical comparator method, the club head 4 is mounted face down and generally horizontal on a V-block mounted on an optical comparator. The club head 4 is oriented such that the score lines 11 are generally parallel with the X-axis of the optical comparator. More precise orientation steps may also be used. Measurements are then taken at the geometric center point 5*a* on the club face. Further measurements are then taken 20 millimeters away from the geometric center point 5*a* of the club face 6 on either side of the geometric center point 5*a* and along the X-axis X of the club head, and 30 millimeters away from the geometric center point of the club face on either side of the center point and along the X-axis X of the club head. An arc is fit through these five measure points, for example by using the radius function on the machine. This arc corresponds to the circumference of a circle with a given radius. This measurement of radius is what is meant by the bulge radius.

To measure the roll, the club head 4 is rotated by 90 degrees such that the Z-axis Z of the club head is generally parallel to the X-axis of the machine. Measurements are taken at the geometric center point 5*a* of the club face. Further measurements are then taken 15 millimeters away from the geometric center point 5*a* and along the Z-axis Z of the club face 6 on either side of the center point 5*a*, and 20 millimeters away from the geometric center point and along the Z-axis of the club face on either side of the center point. An arc is fit through these five measurement points. This arc corresponds to the circumference of a circle with a given radius. This measurement of radius is what is meant by the roll radius.

Curvature is defined as 1/R wherein R is the radius of the circle which corresponds to the measurement arc of the bulge or the roll. As an example, a bulge with a curvature of 0.020 $cm^{-1}$ corresponds to a bulge measured by a bulge measurement arc which is part of a circle with a radius of 50 cm. A roll with a curvature of 0.050 cm−1 corresponds to a roll measured by a roll measurement arc which is part of a circle with a radius of 20 cm.

Moments of Inertia (MOI)

Golf club head moments of inertia are typically defined about axes extending through the golf club head center of gravity. In general, and as shown in FIGS. 2 and 3, the club head 4 center of gravity 5*f* is positioned within the club head. FIG. 3 further illustrates the CG X-axis CGX and the CG Y-axis CGY which pass through the center of gravity 5*f*. The CG Z-axis (not shown) passes through the center of gravity 5*f* and out of the page. The center of gravity 5*f* is located approximately midway between the heel 5*b* and the toe 5*c* along the CG X-axis, and approximately midway between the crown 5*d* and the sole 5*e* along the CG Z-axis of the club head 4. Additionally, as shown by FIG. 3, the center of gravity 5*f* is located approximately midway between the club face 6 and the rear of the club 12 along the CG Y-axis of the club head 4. It is understood that the center of gravity 5*f* position will vary based on a variety of club head features.

A moment of inertia about a golf club head CG X-axis such as that shown in FIG. 2, is calculated by the following equation:

$$I_{xx}=\int(y^2+z^2)dm$$

where y is the distance from a golf club head CG XZ-plane to an infinitesimal mass dm and z is the distance from a golf club head CG XY-plane to the infinitesimal mass dm. The golf club head CG XZ-plane is a plane defined by the golf club head CG X-axis and the golf club head CG Z-axis, as shown in FIGS. 2 and 3.

Similarly, a moment of inertia about the golf club head CG Z-axis is calculated by the following equation:

$$I_{zz}=\int(x^2+y^2)dm$$

where x is the distance from the golf club head CG YZ-plane to an infinitesimal mass dm and y is the distance from the golf club head CG XZ-plane to the infinitesimal mass dm.

According to the present disclosure, the MOI about the CG X axis $I_{xx}$ is at least about 2500 $g\cdot cm^2$ and can be as high as about 5000 $g\cdot cm^2$. The MOI about the CG Z axis $I_{zz}$ is greater than $I_{xx}$ and is at least about 4400 $g\cdot cm^2$ and can be as high as about 6000 $g\cdot cm^2$. It is understood that the MOI about the CG Z axis can be higher than 6000 $g\cdot cm^2$.

Conventional club face geometry is not necessarily compatible with high MOI clubs. Thus, a change in bulge and roll geometry is described in view of these increased MOIs about the CG X-axis $I_{xx}$ and the CG Z-axis $I_{zz}$.

Increased $I_{zz}$ and Increased Bulge Radius

If the MOI around the CG Z axis $I_{zz}$ is increased, then the gear effect for off-center hits will be reduced as explained above. This will result in the golf ball 10 acquiring less spin and thus curving less in flight. With conventional bulge geometry, the reduced spin of a heel shot makes it less likely that the ball's flight path initially to the left of the target line will return to the target line upon landing. Similarly, with conventional bulge geometry the reduced spin of a toe shot makes it less likely that the ball's initial flight path to the right of the intended target line will return to the target line upon landing. However, if the radius of the bulge 8 is increased to flatten the club face 6, then a golf ball 10 struck on the heel 5*b* of the club head 4 will leave at a smaller angle Θ relative to the centerline of the swing 20, compensating for the reduced gear effect associated with a club having a relatively high MOI.

Figure 4:
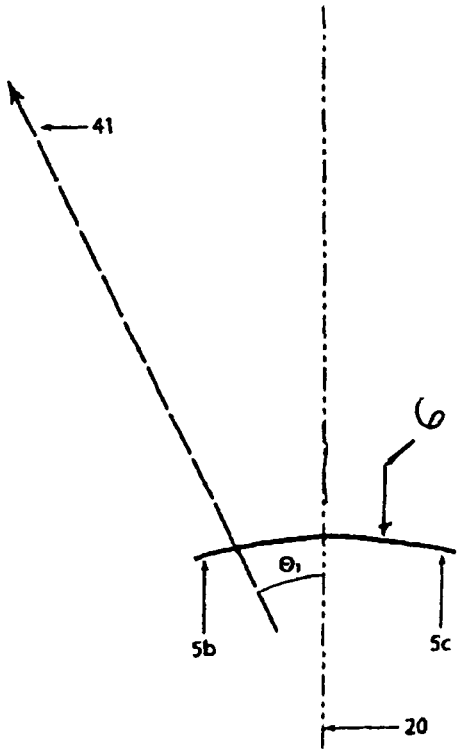
FIG. 4 is an exaggerated top-down illustration of an exemplary flight path of a golf ball hit by a club head with a first bulge radius.
Figure 4A:
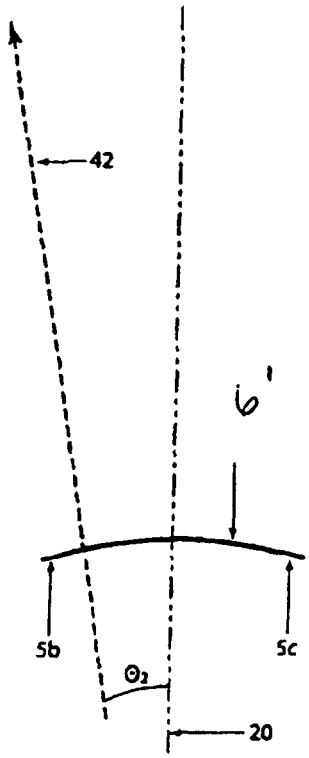
FIG. 4A is an exaggerated top-down illustration of an exemplary flight path of a golf ball hit by a club head with a second bulge radius.

FIG. 4 illustrates a hypothetical club head face 6 that has an exaggerated bulge but no gear effect striking a golf ball with the heel 5*b* of the club head. Flight path 41 shows the flight path of a golf ball leaving a club head face 6 with a first bulge and with no gear effect at some angle $\Theta_1$ relative to the Y-axis of the golf club 20. By contrast, FIG. 4A illustrates the flight path 42 of a golf ball leaving a club head face 6' (again with no gear effect) having a second bulge with a radius greater than the first bulge shown in FIG. 4. Flight path 42 leaves the golf club at some angle $\Theta_2$ relative to Y-axis of the golf club 20. It can be seen that $\Theta_2$ is less than $\Theta_1$ due to the flatter surface of club head face 6'.

Figure 4B:
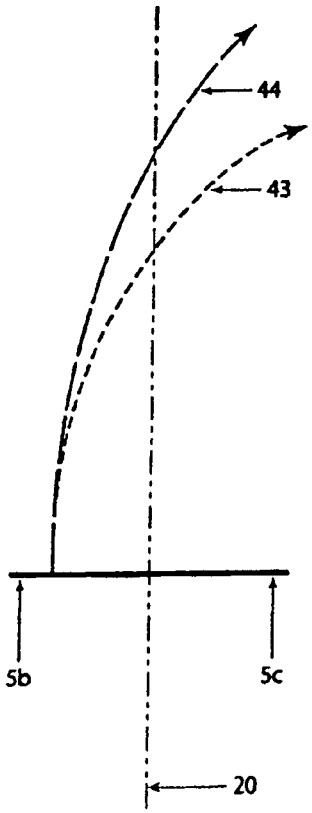
FIG. 4B is an exaggerated top-down illustration of different flight paths of a golf ball according to varying moments of inertia along the Z axis, $I_{zz}$.

FIG. 4B illustrates two hypothetical club heads that have no bulge but do have differing moments of inertia $I_{zz}$ which produce differing gear effects as discussed above. Flight path 43 shows the flight path of a golf ball leaving a club head face of a club having a lower $I_{zz}$, and thus a higher gear effect. It can be seen that the flight path 43 curves more to the right due to greater ball spin. By contrast, flight path 44 shows the flight path of a golf ball leaving a club head face having an increased $I_{zz}$, and thus a reduced gear effect. It can be seen that flight path 44 curves less than flight path 43. As described above, the flight paths 43, 44 curve because the club head rotates when the club head strikes a ball at a point not aligned with the center face of the club head. This twisting causes the ball to acquire a spin which results in a curved flight path. If the club head has a higher $I_{zz}$ then it will twist less than a club head with a lower $I_{zz}$ and impart less spin (and thus a straighter flight path) to the golf ball.

Increased $I_{xx}$ and Decreased Roll Radius

Figure 5:
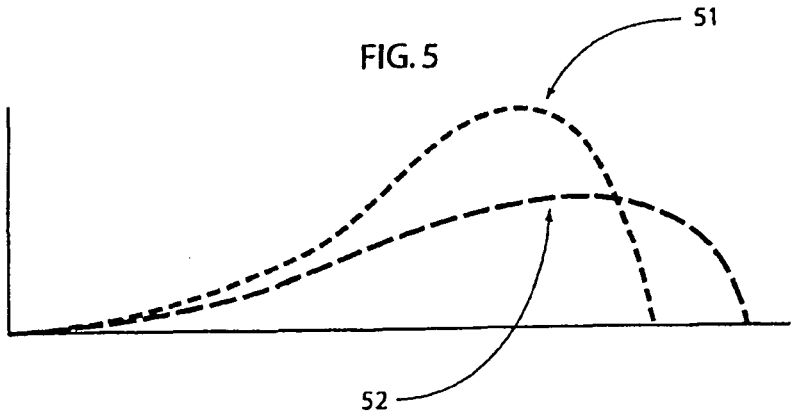
FIG. 5 is a side-view illustration of different flight paths of a golf ball with varying amounts of backspin according to the present disclosure.

Making reference to elements described in FIGS. 1 and 2, the roll 9 of the club head 4 can contribute to the amount of backspin that the golf ball 10 acquires when it's struck by the club head 4 at a point on the club face 6 either above or below the center face 5*a* of the club head 4. Shots struck at a point on the club face 6 below the center face 5*a* of the club head 4 have a greater amount of backspin than shots struck above the center face 5*a*, as described above. FIG. 5 shows the flight path 51 of a golf ball 10 with a high amount of backspin. It can be seen that the flight path "balloons" upward and then drops precipitously. By contrast a flight path 52 is shown of a golf ball 10 with a lower amount of backspin. It can be seen that the flight path "balloons" much less and thus the ball travels farther.

If the roll 9 of the club head is decreased, there will be a decreased variance between backspin for shots struck above the center of face 5*a* of the club head 4 and shots struck below the center face 5*a*. A similar effect is observed when the MOI about the X axis, $I_{xx}$, is increased; namely less twisting of the golf club head 4. When the golf ball 10 is struck at a point below the center face 5*a* of the club head 4, this reduction in twisting of the golf club head 4 ultimately results in less variance in backspin between shots struck above the center face 5*a* of the club head 4 and shots struck below the center face. By combining the effects of the increased MOI, $I_{xx}$, and the decreased roll 9, the variance of backspin between a shot struck above the center face 5*a* of the club head 4 and a shot struck below the center face 5*a* of the club head 4 will be decreased, thus decreasing the variance in the landing position of a golf ball 10. Furthermore, altering the roll of a club head may affect launch angle. Because the launch angle will also affect the landing position of the ball, a roll for a golf club head may be selected that balances a desired launch angle with a desired spin to provide desired performance of the golf club.

Effects of Variable Face Thickness

Figure 6A:
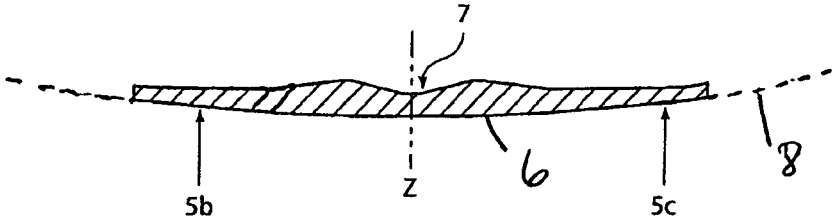
FIG. 6A is a cross-sectional illustration along the Z-axis of the golf club face according to the present disclosure.
Figure 6B:
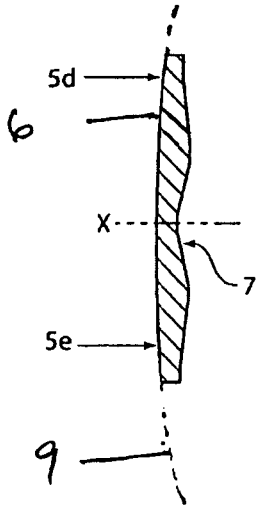
FIG. 6B is a cross-sectional illustration along the X-axis of the golf club face according to the present disclosure.

Additional factors may likewise contribute to gear effect. One such factor is variable face thickness, wherein the club face 6 has a variable thickness at different areas of the club face. Generally this thickness is measured as defining a front side and a back side of the club face 6, and then measuring the distance between the front side and the back side and a plurality of points, although different measurement techniques are also permissible and fall within the spirit and scope of this disclosure. Examples of variable face thickness can be found in U.S. Pat. Nos. 6,800,038, 6,824,475, 6,997,820, and 7,066,832, which are owned by the assignee of the present disclosure and the contents of which are herein incorporated by reference. FIGS. 6A and 6B show cross-sectional views of one possible example of a club face 6 having a variable face thickness which is thinner at a center portion 7 of the club face than at other areas of the club face.

The variable face thickness can create a higher ball speed for shots struck off center, for example near the heel 5*b* or the toe 5*c* of the club face 6. This effect increases the overall effective area of the CUR on the club face 6. The variable face thickness can also limit the COR at the center face of the club face 5*a* to be below the legal limit. As described above, a higher COR generally leads to an increased gear effect. It will be understood, then, that the combination of the COR and the variable face thickness increases the gear effect for shots struck off center, thus reinforcing the need for a club face 6 with a higher bulge 8 and a lower roll 9 to compensate for the increase in gear effect.

Trends In Simulated Results—Roll

The preferred embodiment of the present disclosure has a roll radius that is less than the bulge radius. In certain embodiments the bulge radius is 7.62 cm greater than the roll radius. The bulge curvature is between about 0 $cm^{-1}$ and about 0.027 $cm^{-1}$ and the inverse of the bulge curvature is greater than the inverse of the roll curvature by at least 7.62 cm, although other embodiments may have more or less of a difference. In other words, the bulge curvature, $K_b$ (cm), and roll curvature, $K_r$ (cm) satisfy the equation:

$$\frac{1}{K_b} \geq \frac{1}{K_r} + 7.62(\text{cm})$$

Figure 7:
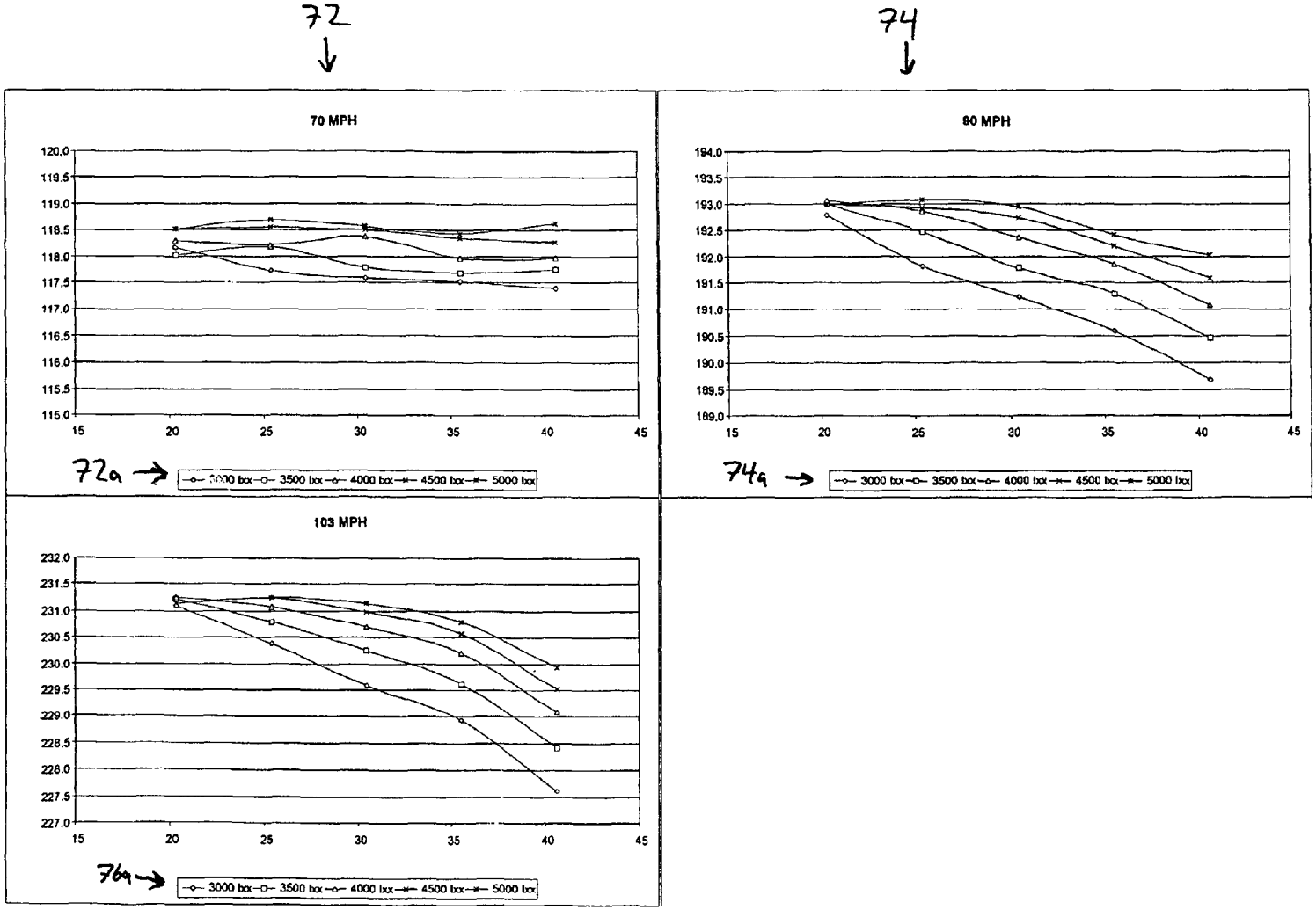
FIG. 7 is a graph of computer simulated experimental results indicating a preferred roll radius at different club headspeeds.

Computer simulations were performed with a variety of different testing parameters. FIG. 7 shows the average carry distance, in yards, for a plurality of headspeeds and MOIs about the X axis $I_{xx}$. Graphs are depicted for headspeeds of 70 mph (72), 90 mph (74), and 103 mph (76). In each of these graphs, the X-axis depicts roll radii in centimeters, and the Y-axis depicts the average carry distance in yards. Each line depicts simulated results for a different MOI about the X axis $I_{xx}$ as indicated by the legends 72(*a*), 74(*a*), and 76(*a*), respectively. These graphs were produced by a computer simulation where the club face impacted a ball at a point on the club face corresponding to the center face, 1.27 cm above the point on the club face corresponding to the center face, and 1.27 cm below the point on the club face corresponding to the center face. The results of these impacts were then averaged together. In general, the graphs depict a relatively constant carry distance from a roll radius of about 20 cm to about 30 cm, corresponding to roll curvatures of about 0.033 $cm^{-1}$ to about 0.050 $cm^{-1}$. This constancy can be particularly seen for higher $I_{xx}$ values such as the lines corresponding to $I_{xx}$ values of 4500 g·$cm^2$ and 5000 g·$cm^2$ shown in graph 76. This constancy in the computer simulation indicates that, for the majority of head speeds and $I_{xx}$ values, the roll radius should be between about 15.2 cm and about 30.5 cm, corresponding to roll curvatures of between about 0.033 $cm^{-1}$ and about 0.066 $cm^{-1}$. As indicated by these computer simulations, an ideal range of roll radii is between about 20.3 cm and about 25.4 cm, corresponding to a preferred roll curvature range between about 0.039 $cm^{-1}$ and about 0.049 $cm^{-1}$.

Figure 8:
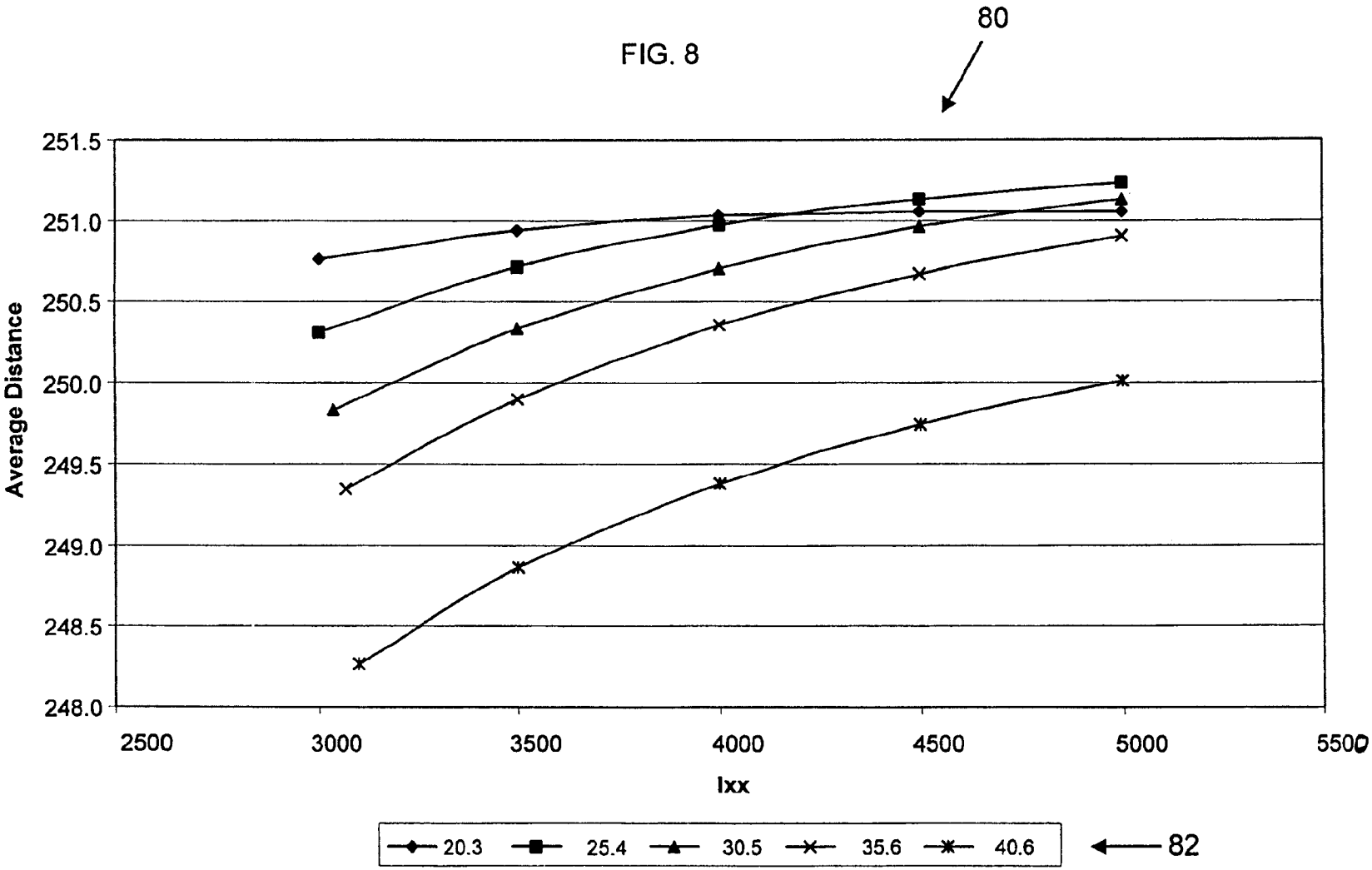
FIG. 8 is a graph illustrating the relationship between distance and moment of inertia along the X axis, $I_{xx}$, using different roll radii according to the present disclosure.

FIG. 8 depicts a graph 80 showing roll for a plurality of different MOI around the CG X axis, $I_{xx}$, according to computer simulations using one exemplary embodiment. For these simulations, the bulge radius was set at 35.56 cm, corresponding to a bulge curvature of about 0.028 $cm^{-1}$, and the $I_{zz}$ value was set at 5160 g·$cm^2$. Impact locations were simulated for impacts at the point on the club face corresponding to the center face, on the Z-axis Z 1.27 cm above the center face of the club, and on the Z-axis Z 1.27 cm below the point on the club face corresponding to the center face. The average distance (in yards) of ball travel is depicted along the Y axis of graph 80, and MOI about the CG X axis $I_{xx}$ is depicted along the X axis of the graph. Each of the different lines corresponds to a different roll radius as indicated by key 82. As can be seen by graph 80, the roll radius for MOI about the CG X axis $I_{xx}$, below about 4150 g·$cm^2$, is 20.3 cm, corresponding to a roll curvature of about 0.049 $cm^{-1}$. The roll radius for MOI about the CG X axis $I_{xx}$, above about 4150 g·$cm^2$, is 25.4 cm, corresponding to a roll curvature of about 0.039 $cm^{-1}$. In other examples, the relationships may be different based upon factors such as club size or configuration, wind, or club headspeed, These factors may combine to alter the ideal roll radius for different MOI about the CG X axis $I_{xx}$, and may additionally result in different average, distance measurements dependant upon environmental and user-related factors.

Trends in Simulated Results—Bulge

Computer simulations were performed to determine bulge radii for a variety of MOIs about the CG Z axis, $I_{zz}$. The data used to calculate these simulated results is based on a series of simulated impacts using a variable inertia club model. Impacts were modeled on the center face X-axis X 1.905 cm away from the point on the club face corresponding to the center face of the golf club towards the heel and the toe of the golf club, and on the X-axis X 3.175 cm away from the point on the club face corresponding to the center face of the golf club towards the heel and the toe. Impact speeds used were 70 mph, 90 mph, 103 mph, and 130 mph. For this test, $I_{zz}$ values ranged from 4000 g·$cm^2$ to 6000 g·$cm^2$. Results for the tests were then averaged and are shown in Tables 1 and 2, below. Table 1 represents averaged results for hits 1.905 cm away from the center face of the golf club, and table 2 represents averaged results for hits 3.175 cm away from the center face of the golf club. $R_{Bulge}$ is the bulge radius, in centimeters.

TABLE 1

| Headspeed (MPH) | Bulge Radius Equation (cm.) |
|---|---|
| 70 | $R_{Bulge} = 0.00466 * I_{zz} + 23.54$ |
| 90 | $R_{Bulge} = 0.00556 * I_{zz} + 12.56$ |
| 103 | $R_{Bulge} = 0.00525 * I_{zz} + 12.15$ |
| 130 | $R_{Bulge} = 0.00459 * I_{zz} + 14.39$ |

TABLE 2

| Headspeed (MPH) | Bulge Radius Equation (cm.) |
|---|---|
| 70 | $R_{Bulge} = 0.00592 * I_{zz} + 16.6$ |
| 90 | $R_{Bulge} = 0.00458 * I_{zz} + 12.95$ |
| 103 | $R_{Bulge} = 0.00394 * I_{zz} + 13.5$ |
| 130 | $R_{Bulge} = 0.00306 * I_{zz} + 14.4$ |

The results of tables 1 and 2 were then averaged together according to a statistical model which takes into account impact location standard deviation versus headspeed at impact. It is expected that there would be larger deviations for shots which are further off-center towards the heel or the toe of the club than for shots closer to the center face of the club. A weighted slope and intercept for the bulge radius equation shown in Table 1 and 2 were then found, as shown in Table 3:

TABLE 3

| Headspeed (MPH) | Slope | Intercept |
|---|---|---|
| 70 | 0.00517 | 20.77 |
| 90 | 0.00522 | 12.69 |
| 103 | 0.00486 | 12.56 |
| 130 | 0.00421 | 14.39 |

As can be seen from Table 3, the bulge radius, $R_{Bulge}$, (in centimeters) for a golf club swung with a headspeed of 70 mph, according to the computer simulation, is $R_{Bulge}=0.00517*I_{zz}+20.8$. Similarly, the bulge radius, $R_{Bulge}$, (in centimeters) for a golf club swung with a headspeed of 90 mph is $0.00522*I_{zz}+12.7$. Similar results are obtained for the other headspeeds by referring to Table 3.

The slopes and intercepts for each headspeed from Table 3 were then averaged together according to a weighted model dependant on the likelihood of a golfer swinging a club at that headspeed. For example, very few players actually swing a golf club with a 130 mph headspeed, however a 90 mph headspeed is more common. This weighted averaging produced a slope of 0.00505 and an intercept of 13.95. Thus, in one preferred embodiment, the ideal bulge (in centimeters) for a given MOI about the CG Z axis, $I_{zz}$, can be determined by the equation $R_{Bulge}=0.00505*I_{zz}+13.95$.

As described above, the preferred MOI about the CG Z axis $I_{zz}$ is between about 4400 g·cm$^2$ and about 6000 g·cm$^2$. Thus the preferred $R_{Bulge}$ is between about 36.17 cm and about 44.25 cm, respectively corresponding to a preferred bulge curvature range between about 0.023 cm$^{-1}$ and about 0.028 cm$^{-1}$. In other embodiments, the bulge curvature may be even lower, such as 0.016 cm$^{-1}$, which corresponds to a bulge radius of about 60.96 cm. In certain extreme embodiments the bulge curvature may be as low a 0 cm$^{-1}$. Different results within a reasonable margin of error may be obtained using different statistical models, therefore slight variations of these values are also envisioned.

Figure 9:
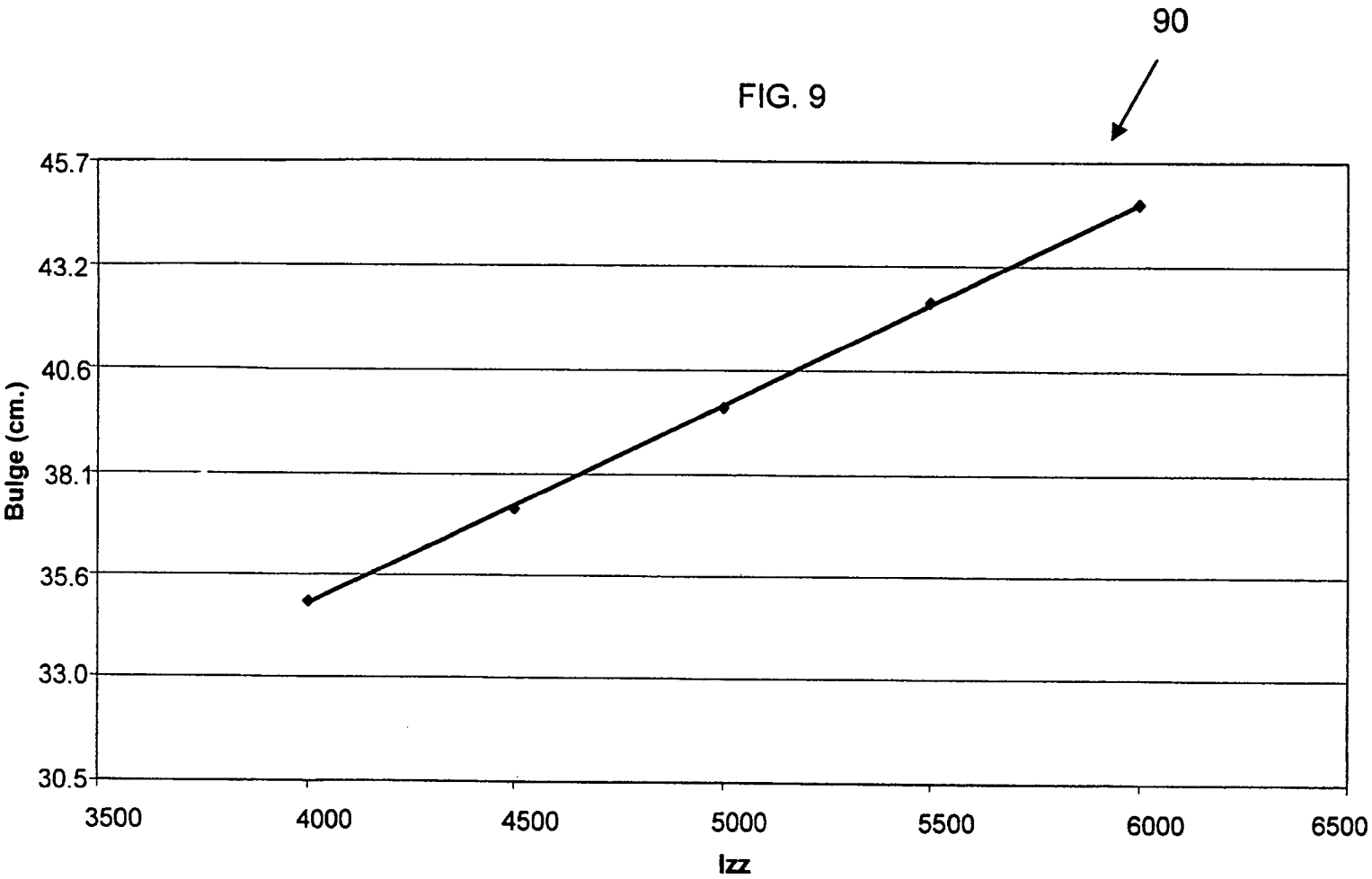
FIG. 9 is a graph illustrating the relationship between the ideal bulge radius and $I_{zz}$.

FIG. 9 depicts a graph 90 showing a computer simulated bulge as a function of MOI around the CG Z axis $I_{zz}$ for one exemplary embodiment of the present disclosure. Bulge, in centimeters, is depicted along the Y axis of graph 90, and MOI about the CG Z axis $I_{zz}$ is depicted along the X axis of the graph. As shown by graph 90, bulge is generally related to MOI around the Z axis $I_{zz}$ such that the bulge is increased by roughly five centimeters per 1000 g·cm2 increase of MOI around the CG Z axis $I_{zz}$. In other examples, the relationship may be slightly different based on factors such as the specific club size or configuration, wind, or club head speed.

Trends in Simulated Results—Bulge/Roll

As described above, it is envisioned that, in the preferred embodiment, the radius of the roll is between 20.3 centimeters and 25.4 centimeters. For a roll radius $R_{Roll}$ of 20.3 centimeters, this produces the following bulge radius to roll radius equations:

$$70\text{ mph: } \frac{R_{Bulge}}{R_{Roll}} = \frac{0.00517 * I_{ZZ} + 20.8}{20.3} = 2.55 \times 10^{-4} * I_{ZZ} + 1.02$$

$$90\text{ mph: } \frac{R_{Bulge}}{R_{Roll}} = \frac{0.00522 * I_{ZZ} + 12.7}{20.3} = 2.57 \times 10^{-4} * I_{ZZ} + 0.625$$

$$103\text{ mph: } \frac{R_{Bulge}}{R_{Roll}} = \frac{0.00486 * I_{ZZ} + 12.6}{20.3} = 2.39 \times 10^{-4} * I_{ZZ} + 0.613$$

For a range of MOI about the CG Z axis $I_{ZZ}$ between about 3500 g·cm$^2$ and about 6000 g·cm$^2$, these equations give the following range of bulge radius to roll radius ratios for each head speed:

70 mph: 1.90:1-2.55:1

90 mph: 1.53:1-2.17:1

103 mph: 1.45:1-2.05:1

In the preferred embodiment, using the ideal $R_{Bulge}$ equation $R_{Bulge}=0.00505*I_{zz}+13.95$, the ratio of the bulge radius to the roll radius becomes:

$$\frac{R_{Bulge}}{R_{Roll}} = \frac{0.00505 * I_{ZZ} + 13.95}{20.3} = 2.488 \times 10^{-4} * I_{ZZ} + 0.6875$$

Using a range of MOIs about the CG Z axis, $I_{zz}$, between about 4400 g·cm$^2$ and about 6000 g·cm$^2$, this equation produces a range for the ratio of the bulge radius to the roll radius between 1.78:1-2.13:1.

A similar range of ratios can be obtained by using the upper limit of the preferred roll radius, 25.4 centimeters. The preferred ratio of the bulge radius to the roll radius becomes:

$$\frac{R_{Bulge}}{R_{Roll}} = \frac{0.00505 * I_{ZZ} + 13.95}{25.4} = 1.988 \times 10^{-4} * I_{ZZ} + 0.5492$$

Using a range of MOIs about the CG Z axis, $I_{zz}$, between about 4400 g·cm$^2$ and about 6000 g·cm$^2$, this equation produces a range for the ratio of the bulge radius to the roll radius between 1.42:1-1.74:1

Because the curvature is defined as $1/R_{Bulge}$ or $1/R_{Roll}$, the ratio of the bulge curvature to the roll curvature can be defined as $1/(R_{Bulge}/R_{Roll})$. Useful bounding equations can then be defined according to the computer simulation for the ratio of the bulge curvature to the roll curvature, $R_C$, in the preferred embodiment as:

$$\frac{1}{(2.488x10^{-4} * I_{ZZ}) + 0.6875} \leq R_C \leq \frac{1}{(1.988x10^{-4} * I_{ZZ}) + 0.5492}$$

A broader ratio of curvatures $R_C$ can also be defined using the broader range of roll radii between 15.24 centimeters and 30.48 centimeters as follows:

$$\frac{1}{(3.3x10^{-4} * I_{ZZ}) + 0.9154} \leq R_C \leq \frac{1}{(1.7x10^{-4} * I_{ZZ}) + 0.4574}$$

Trends in Experimental Results—Bulge

Experimental testing of varying bulge radii and MOI about the CG Z axis $I_{zz}$ was conducted, and the bulge for each $I_{zz}$ was found for a plurality of $I_{zz}$. The results are summarized as follows:

TABLE 4

| $I_{zz}$ (g · cm$^2$) | Bulge radius (cm.) | Bulge/Roll (Roll radius: 15.24 cm.) | Bulge/Roll (Roll radius: 30.48 cm.) | Curvature ratio (Roll radius: 15.24 cm) | Curvature ratio (Roll radius: 30.48 cm.) |
|---|---|---|---|---|---|
| 4400 | 40.6 | 2.67 | 1.33 | 0.38 | 0.75 |
| 5000 | 45.7 | 3.00 | 1.50 | 0.33 | 0.67 |
| 5500 | 50.0 | 3.28 | 1.64 | 0.31 | 0.61 |
| 6000 | 54.2 | 3.56 | 1.78 | 0.28 | 0.56 |

The data in Table 4 was then linearly fit to determine a linear slope and intercept for the bulge radius for differing MOIs about the CG Z axis, $I_{zz}$. In general, experimental testing results as shown in Table 4 indicate that the ideal bulge radius for a given MOI about the CG Z axis, $I_{zz}$ can be found using the equation $R_{Bulge}$=0.0085*$I_{zz}$+3.387 where R is the bulge radius, in centimeters.

These experimental results further indicate a range for the ratio of the bulge curvature divided by roll curvature, indicated by the variable $R_C$. This range can be expressed by the equation:

$$\frac{1}{(5.6x10^{-4} * I_{ZZ}) + 0.222} \leq R_C \leq \frac{1}{(2.8x10^{-4} * I_{ZZ}) + 0.111}$$

Again, the roll radii in the above equation is between 15.24 cm and 30.48 cm. This ratio and these experimental results are useful in that they indicate a range of preferred bulge curvature to roll curvature ratios ($R_C$) for a range of MOIs about the CG Z axis, $I_{zz}$. For example, the overall range for $R_C$ for $I_{zz}$ between about 4400 g·cm$^2$ and about 6000 g·cm$^2$ is between 0.28 and 0.75. The range for $R_C$ for $I_{zz}$ between about 4400 g·cm$^2$ and about 5000 g·cm$^2$ is between about 0.33 and 0.75. The other ranges for $R_C$ for this embodiment of the golf club can be found by reference to Table 1, above.

At least one advantage of the present invention is that the bulge and roll ranges described herein more adequately compensate for gear effect, thus improving accuracy while improving the distance traveled by a golf ball for large $I_{zz}$ golf club heads.

In addition, at least one advantage of the present invention is that the bulge and roll curvature ratio described herein accommodates for variations in swing speed. The bulge and roll curvature ratio discovered in the experimental test data described above, achieves maximum performance in large MOI golf club heads through a variety of swing speeds.

Furthermore, the bulge to roll ratio range described above was an unexpected outcome due to the incorrect initial assumption that bulge to roll ratio would be simply 1:1. In the process of discovering the present invention, a flatter face unexpectedly provided a shorter distance golf shot. However, increasing roll curvature to achieve more distance would sacrifice accuracy under a 1:1 ratio of bulge to roll curvature.

Thus, the present invention discloses the most preferred and effective bulge to roll curvature ratio. Therefore, straighter and longer golf shots are possible.

In view of the many possible embodiments to which the principles of the disclosed invention may be applied, it should be recognized that the illustrated embodiments are only preferred examples of the invention and should not be taken as limiting the scope of the invention.

We claim:

1. A golf club head comprising:

a club head body having an external surface with a heel portion, a toe portion, a crown, a sole, and a face;

a moment of inertia about the CG Z axis, $I_{zz}$; and a moment of inertia about the CG X axis, $I_{xx}$, wherein $I_{xx}$ is at least about 3000 g·cm$^2$ and wherein $I_{zz}$ is greater than $I_{xx}$;

wherein the face includes:

a front side and a back side that define a variable face thickness;

a bulge curvature and a roll curvature; and wherein a ratio of bulge curvature divided by roll curvature, $R_C$, satisfies the following:

$$\frac{1}{3.3x10^{-4} * I_{ZZ} + 0.9154} \leq R_C \leq \frac{1}{1.7x10^{-4} * I_{ZZ} + 0.4574}.$$

2. The golf club head of claim 1 wherein the roll curvature is between about 0.033 cm$^{-1}$ and about 0.066 cm$^{-1}$, and wherein the bulge curvature is between about 0.016 cm$^{-1}$ and about 0.028 cm$^{-1}$.

3. The golf club head of claim 1 wherein the golf club head has a mass between about 170 grams and about 220 grams.

4. A golf club comprising:

a shaft with a golf club head coupled thereto;

the club head body comprising:

an external surface with a heel portion, a toe portion, a crown, a sole, and a face;

a moment of inertia about the CG Z axis, $I_{zz}$; and a moment of inertia about the CG X axis, $I_{xx}$, wherein $I_{xx}$ is at least about 3000 g·cm$^2$ and wherein $I_{zz}$ is greater than $I_{xx}$;

wherein the face includes:

a front side and a back side that define a variable face thickness;

a bulge curvature and a roll curvature; and wherein the ratio of the bulge curvature divided by the roll curvature, $R_C$, satisfies the following:

$$\frac{1}{(5.6x10^{-4} * I_{ZZ}) + 0.222} \leq R_C \leq \frac{1}{(2.8x10^{-4} * I_{ZZ}) + 0.111}.$$

wherein a bulge radius, $R_{Bulge}$, is defined as the inverse of the bulge curvature, and wherein $R_{Bulge}$ satisfies the equation $R_{Bulge}$=0.0085×$I_{ZZ}$+3.387.

5. The golf club of claim 4 wherein the ratio of the bulge curvature divided by the roll curvature, $R_C$, is greater than about 0.28 and less than about 0.75.

6. The golf club of claim 4 wherein the roll curvature is between about 0.033 $cm^{-1}$ and about 0.066 $cm^{-1}$, and wherein the bulge curvature is greater than 0 $cm^{-1}$ and less than about 0.027 $cm^{-1}$ and the inverse of the bulge curvature is greater than the inverse of the roll curvature by at least 7.62 cm.

* * * * *